US005637147A

United States Patent [19]

Bartsch

[11] Patent Number: 5,637,147

[45] Date of Patent: Jun. 10, 1997

[54] CALENDAR FOR PRODUCING A SHEET HAVING WAX-CONTAINING DISPERSION THEREON

[75] Inventor: Peter Bartsch, Burgthann-Unterferrieden, Germany

[73] Assignee: Billhoefer Maschinenfabrik GmbH, Nuremberg, Germany

[21] Appl. No.: 573,908

[22] Filed: Dec. 18, 1995

Related U.S. Application Data

[63] Continuation of Ser. No. 271,347, Jul. 6, 1994, abandoned.

[30] Foreign Application Priority Data

Jul. 7, 1993 [DE] Germany ..... 43 22 644.2
Dec. 21, 1993 [DE] Germany ..... 93 19 666 U

[51] Int. Cl.[6] ..... B05C 11/02

[52] U.S. Cl. ..... 118/60; 118/106; 118/121; 162/206; 100/176

[58] Field of Search ..... 118/60, 70, 76, 118/106, 111, 116, 121, 239, 299, 253, 257, 261, 413, 641; 162/206, 359.1; 100/93 RP, 176; 34/122, 123

[56] References Cited

U.S. PATENT DOCUMENTS

| | | | |
|---|---|---|---|
| 3,067,718 | 12/1962 | Kraft | 118/239 |
| 3,349,749 | 10/1967 | Utschig | 118/60 |
| 4,931,143 | 6/1990 | Karvinen et al. | 162/359.1 |
| 5,043,046 | 8/1991 | Laapotti | 162/358.5 |
| 5,092,962 | 3/1992 | Koski | 162/358.5 |
| 5,131,983 | 7/1992 | Pulkowski et al. | 162/358.5 |
| 5,137,678 | 8/1992 | Hess et al. | 162/206 |
| 5,251,551 | 10/1993 | Abe et al. | 100/93 RP |
| 5,254,165 | 10/1993 | Haruna | 118/60 |
| 5,329,844 | 7/1994 | Koivukunnas et al. | 100/93 RP |
| 5,354,612 | 10/1994 | Miyabayashi | 118/60 |

FOREIGN PATENT DOCUMENTS

| | | | |
|---|---|---|---|
| 3535685 | 4/1987 | Germany . | |
| 9213133 | 8/1992 | WIPO | 162/206 |

*Primary Examiner*—Laura Edwards
*Attorney, Agent, or Firm*—Jordan and Hamburg

[57] ABSTRACT

A calender for applying a dispersion of solid resins, wax dispersions and surface materials on sections or particularly sheets, with a heatable calender roller, a counterpressure roller disposed at the inlet of the section or sheet and a take-off roller, which is preferably constructed as a suction roller and offset in the direction of rotation of the calender roller with respect to the counterpressure roller, as well as, optionally, an air knife disposed in the outlet gap, one or several counterpressure rollers being provided and the diameters of the calender roller and/or of the counterpressure rollers, as well as their mutual contacting pressure, being selected so that the width of the pressure strip of the mutual contact, when a counterpressure roller is provided, is between 20 mm and 45 mm and preferably about 35 mm.

16 Claims, 1 Drawing Sheet

CALENDAR FOR PRODUCING A SHEET HAVING WAX-CONTAINING DISPERSION THEREON

This application is a continuation of application Ser. No. 08/271,347, filed Jul. 6, 1994, now abandoned.

BACKGROUND OF THE INVENTION

The invention relates to a calender for applying a dispersion of solid resins, wax dispersions and surface materials on sections or particularly on sheets, with a heatable calender roller, a counterpressure roller disposed at the inlet of the section or sheet and a take-off roller, which is preferably constructed as a suction roller and offset in the direction of rotation of the calender roller with respect to the counterpressure roller, as well as, optionally, an air knife disposed in the outlet gap.

Such calenders enable a mirror finish to be achieved at the specular surface of the calender roller by melting a calender lacquer applied on the section or sheet. For such calenders, for example, those of the German Offenlegungsschrift 35 35 685 A1, calender roller diameters of 450 mm and counterpressure roller diameters of less than 200 mm are customary. Moreover, it is also usual to dispose the take-off roller at a short distance, that is, offset by less than about 90° at the periphery, behind the counterpressure roller.

When applying particularly aqueous dispersions of solid resins, wax dispersions and surface materials, which have the advantage, when applied in small mounts on the surface, of getting along without pollutants, such as organic solvents, difficulties arise, however, when the conventional calender is used, since the desired high gloss surfaces, which are customary for calendering, cannot be achieved or the throughput rates must be kept so low, that it is not possible to work economically.

SUMMARY OF THE INVENTION

It is therefore an object of the invention to design a calender of the initially-named type in such a way that, even when the addressed, special dispersions are used at high throughput rates, a mirror finish of the calendered lacquer surface can be achieved.

To accomplish this objective, provisions are made pursuant to the invention so that one or several counterpressure rollers are provided and that the diameters of the calender roller and/or the counterpressure rollers, as well as their mutual contacting weight, are selected so that the width of the pressure strip of their mutual contact, when a counterpressure roller is provided, is between 20 mm and 45 mm and preferably about 35 mm, when a counterpressure roller is provided.

Due to the inventive diameters of the calender roller and the counterpressure roller, which are enlarged appreciably compared to conventional calenders to about 1,000 mm in the case of the calender roller and about 400 to 500 mm in the case of the counterpressure roller, the large width of the pressure strip of preferably about 35 mm, which brings about an initial ignition for the special dispersion lacquer with waxes, is brought about at a preferred weight between 10 and 20 tons in such a way that the lacquer actually melts during its passage through this large weight strip width and the desired mirror finish develops.

If several pressure rollers are provided, which are distributed over the segment between the first pressure roller and the take-off roller, the contacting pressure may optionally be reduced, since the initial ignition addressed for the special dispersion lacquer does not then have to be mustered by the one pressure roller alone; instead, the additional pressure rollers can also contribute to this.

In this connection, it is of particular importance that, after this initial ignition of the melting process and the development of the mirror finish in the region of the contact between the counterpressure roller and the calender roller, the section or the sheet also remain for still a relatively long time in contact with the heated surface of the calender roller. In a further development of the invention, provisions are made for this in that the rotary speed of the calender roller, in relation to its diameter, and the offsetting of the take-off roller with respect to the counterpressure roller are selected so that a residence time of the section or sheet at the calender roller between the inlet and the outlet of about 2 to 12 seconds and preferably of 6 to 7 seconds results. The offset angle between the take-off roller and the counterpressure roller can be smaller than 180°, provided that the diameter of the calender roller is appropriately dimensioned and the rotational speed of the calender roller, which is related to the diameter of this roller, is adjusted so that the residence time necessary for developing the coating properties is attained and the path is sufficiently long.

In order to increase the residence time of the sheets at the heated calender surface, it is also possible to use a belt calender, for which an endless steel belt rotates around the calender roller and a guide roller at a distance from the calender roller. Optionally, this steel belt can additionally be heated from the rear, for example, by an infrared heater, in the segment between the calender roller and the guide roller. In the case of such a belt calender, the counterpressure rollers lie against the calender roller and the take-off roller lies against the guide roller, obviously, in each case, with the endless steel belt disposed in between.

In this connection, it has been observed that a section or sheet path between the counterpressure roller and the take-off roller of about 2 m gives very good results even at relatively high running speeds. This 2 m path can readily be achieved with a counterpressure roller having a diameter of 1,000 mm.

The inventive calender is particularly suitable for processing calender lacquers based on aqueous styrene/acrylate dispersions, such as those commercially obtainable under the name of Wikolith VP 302.

BRIEF DESCRIPTION OF THE DRAWING

Further advantages, distinguishing features and details of the invention arise out of the description of some embodiments as well as from the drawing, in which.

DESCRIPTION OF THE PREFERRED EMBODIMENTS

Figure 1:
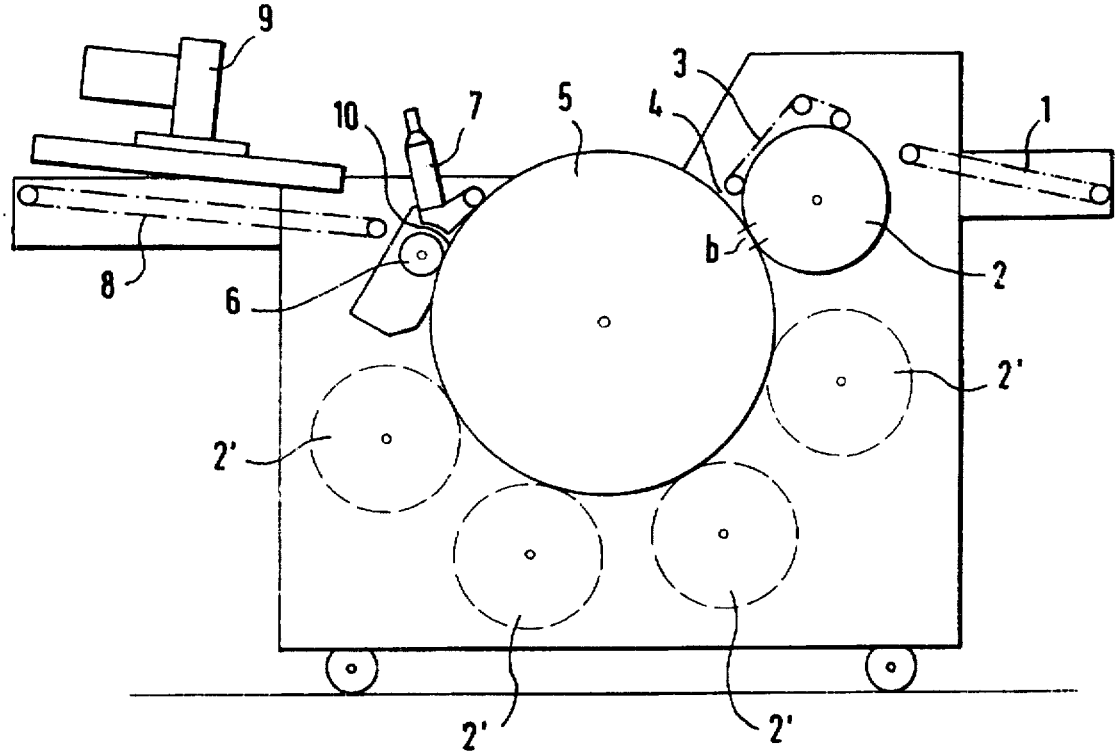
FIG. 1 shows a diagrammatic section through an inventive roller calender and FIG. 2 shows a diagrammatic section through an inventive belt calender.

The sheet-supplying system, on which the sheets run after the aqueous, wax-containing dispersion is applied by way of the counterpressure roller 2, is labeled 1, the sheets being guided by a sheet guiding system 3 over the first counterpressure roller 2. Instead of sheets, it is also possible to process sections. However, the inventive calendering method is preferably employed with sheets. Subsequently, the sheets reach the inlet gap 4 between the counterpressure roller 2 and the calender roller 5, the calender roller having a diameter of about 1,000 mm and the counterpressure roller a diameter of about 400 to 500 mm and the contacting weight between the counterpressure roller and the calender roller being about 15 tons, so that a pressure strip width b of preferably more than 35 mm results. If the temperature of the calender roller is about 100° C. or more, this provides sufficient initial ignition for the dispersion layer, so that the latter melts and the desired mirror finish can develop subsequently during contact with the calender roller up to the take-off roller 6. In order to improve the mirror finish even more and, at the same time, to be able, optionally, to keep the diameter and the contacting weight of the counterpressure rollers smaller, it would be possible to provide optional, additional counter rollers 2', which are shown by broken lines. The offsetting of the take-off roller 6, which preferably is constructed as a suction roller, the detachment of the sheets from the calender roller at outlet gap 10 being aided additionally by an air knife 7, is more than 180° for the roller calender of FIG. 1, so that the sheet is in contact with the calender roller 5 for 6 to 7 seconds even when the sheets are transported at high speeds. Subsequently, the sheets reach a belt delivery section 8 above which, in turn, a cooling blower 9 is disposed. The belt delivery section is also preferably equipped with suction belts, although, of course, the take-off roller 6, as well as the belt delivery section 8 can comprise simple rubber rollers or rubber belts, which are entirely adequate for many applications, that is, for a whole series of sheet materials and sheet thicknesses, in order to ensure, in conjunction with an air knife, a clean detachment of the sheets from the calender roller and their transport on the belt delivery section.

Figure 2:
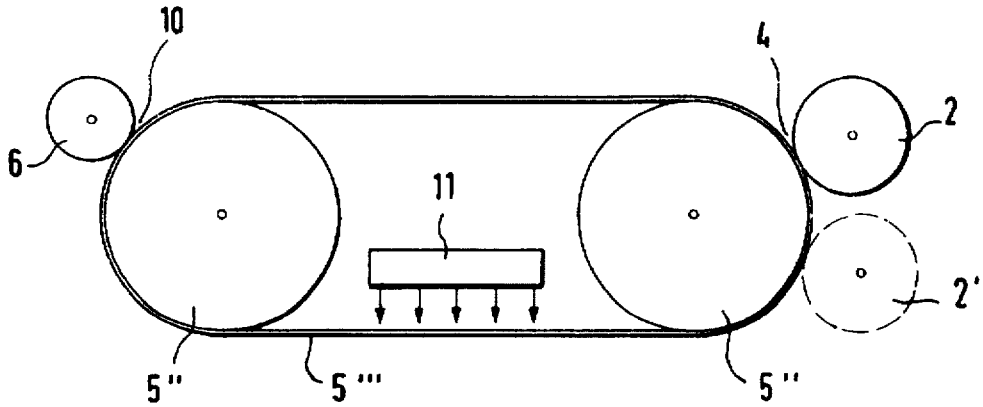

FIG. 2 diagrammatically shows an inventively constructed belt calender for which, aside from the calender roller 5', an endless steel belt 5"' is provided, which runs around the calender roller 5' and a guide roller 5" at a distance from the latter. The counterpressure rollers 2, 2', with interpositioning, of course, of the endless steel belt 5"', press against the calender roller 5', while the take-off roller 6 lies against the guide roller 5". Optional, additional heating of the steel belt 5"' by an infrared heater 11 from the rear on the way between the calender roller 5' and the guide roller 5", results in a very simple possibility for lengthening the contacting segment and also the contacting time at the hot calender surface, which is formed in the present case by the endless steel belt 5"'.

We claim:

1. A calender for producing a sheet having a dispersion of solid resins, wax dispersions and surface materials with a mirror finish, said calender comprising:

a heatable calender roller means rotatable in a given direction, at least one counterpressure roller pressing against a first section of said calender roller means to provide a mutual contacting weight of 10 to 20 tons at a pressure strip of said sheet between said at least one counterpressure roller and said first section of said calender roller means, said pressure strip of said sheet having one side in direct contact with said at least one counter pressure roller and an opposite side in direct contact with said first section of said calender roller means, said calender roller means comprising a cylindrical calender roller element, said cylindrical calender roller element and said at least one counterpressure roller having diameters which, along with said mutual contacting weight, provide that said pressure strip has a width between 20 mm and 45 mm, a take-off roller positioned against said calender roller means at a downstream position offset in the given direction of rotation of the calender roller means from said at least one counterpressure roller by an angle greater than 180°, and the rotary speed of the calender roller means, the diameter of the calender roller means and the offset of the take-off roller from the first counterpressure roller are determined so that a residence time of a section of sheet along said calender roller means is between approximately 2 and 12 seconds, said heating of said calender roller means along with said mutual contacting weight of 10 to 20 tons at said pressure strip with a width of 20 mm to 45 mm and said residence time of 2 to 12 seconds providing a sheet having a dispersion of solid resins, wax dispersions, and surface materials with a mirror finish.

2. A calender according to claim 1, wherein said take-off roller is comprised of a suction roller.

3. A calender according to claim 1, further comprising an air knife disposed adjacent a section of said take-off roller which is positioned immediately downstream of said take-off roller.

4. A calender according to claim 1, wherein said width is approximately 35 mm.

5. A calender according to claim 1, wherein said calender roller means further comprises a guide roller and an endless metal belt rotatably mounted about said guide roller and said cylindrical calender roller element, said metal belt having a portion which constitutes said first section of said calender roller means such that said portion of said metal belt is in direct contact with said opposite side of said pressure strip, said metal belt being positioned between said at least one counterpressure roller and said cylindrical calender roller element such that said at least one counterpressure roller applies pressure to said cylindrical calender roller element through said metal belt, and said guide roller being spaced from said cylindrical calender roller element, said metal belt being positioned between said take-off roller and said guide roller such that said take-off roller applies pressure to said guide roller through said metal belt.

6. A calender according to claim 5, further including heating means for heating an inner portion of said metal belt at a position between said guide roller and said cylindrical calender roller element.

7. A calender according to claim 6, wherein said heating means includes an infrared radiant heater.

8. A calender according to claim 5, wherein said residence time is between approximately 6 and 7 seconds.

9. A calender according to claim 5, further including heating means for heating an inner portion of said endless belt at a position between said roller and said take-off roller.

10. A calender according to claim 1, wherein said residence time is between approximately 6 and 7 seconds.

11. A calender according to claim 1 wherein said calender roller means has a diameter of approximately 1,000 mm and each said counterpressure roller has a diameter of approximately 400 to 500 mm.

12. A calender according to claim 1, wherein said mutual contacting weight is approximately 15 tons.

13. A calender according to claim 1, wherein a path of the section or sheet between said at least one counterpressure roller and the take-off roller is approximately 2 meters.

14. A calender according to claim 1, wherein said calender processes calender lacquers based on aqueous styrene/acrylate dispersions.

15. A calender for producing a sheet having a dispersion of solid reins, wax dispersions and surface materials with a mirror finish, said calender comprising:

a heatable calender roller means rotatable in a given direction, at least one counterpressure roller pressing against a first section of said calender roller means to provide a mutual contacting weight of 10 to 20 tons at a pressure strip of said sheet between said at least one counterpressure roller and said first section of said calender roller means, said pressure strip of said sheet having one side in direct contact with said at least one counter pressure roller and an opposite side in direct contact with said first section of said calender roller means.

said calender roller means comprising a cylindrical calender roller element, said cylindrical calender roller element and said at least one counterpressure roller having diameters which, along with said mutual contacting weight, provide that said pressure strip has a width of approximately 20 mm to 45 mm, a suction take-off roller positioned against said calender roller means at a downstream position offset in the given direction of rotation of the calender roller means from said first counterpressure roller by an angle greater than 180°, the rotary speed of the calender roller means, the diameter of the calender roller means and the offset of the take-off roller from the first counterpressure roller are determined so that a residence time of a section of sheet along said calender roller means is between approximately 2 and 12 seconds, said heating of said calender roller means along with said mutual contacting weight of 10 to 20 tons at said pressure strip with a width of 20 mm to 45 mm and said residence time of 2 to 12 seconds providing a sheet having a dispersion of solid resins, wax dispersions, and surface materials with a mirror finish, and an air knife disposed adjacent a section of said take-off roller which is positioned immediately downstream of said take-off roller.

16. A calender according to claim 15, wherein said calender roller means further comprises a guide roller and an endless metal belt rotatably mounted about said guide roller and said cylindrical calender roller element, said metal belt having a portion which constitutes said first section of said calender roller means such that said portion of said metal belt is in direct contact with said opposite side of said pressure strip, said metal belt being positioned between said at least one counterpressure roller and said cylindrical calender roller element such that said at least one counterpressure roller applies pressure to said cylindrical calender roller element through said metal belt, and said guide roller being spaced from said cylindrical calender roller element, said metal belt being positioned between said take-off roller and said guide roller such that said take-off roller applies pressure to said guide roller through said metal belt.

* * * * *

UNITED STATES PATENT AND TRADEMARK OFFICE

CERTIFICATE OF CORRECTION

PATENT NO. : 5,637,147
DATED : June 10, 1997
INVENTOR(S) : Peter Bartsch

It is certified that error appears in the above-indentified patent and that said Letters Patent is hereby corrected as shown below:

On the Title page, change the Assignee's city address from "Nuremberg" to "Nurenberg".

On the Foreign Application Priority Data, change the second application priority data number from "93 19 666 U" to "93 19 666.0".

Signed and Sealed this

Seventh Day of October, 1997

*Attest:*

Bruce Lehman

BRUCE LEHMAN

*Attesting Officer*

*Commissioner of Patents and Trademarks*